US006109178A

United States Patent [19]

Furukawa

[11] Patent Number: 6,109,178

[45] Date of Patent: Aug. 29, 2000

[54] COMBINED INK FOUNTAIN AND BLADE MOUNTED TO MOVE ALONG LENGTH OF FOUNTAIN ROLL

[75] Inventor: Shigeo Furukawa, Higashikatsushika-gun, Japan

[73] Assignee: Komori Corporation, Tokyo, Japan

[21] Appl. No.: 09/275,190

[22] Filed: Mar. 23, 1999

[30] Foreign Application Priority Data

Mar. 23, 1998 [JP] Japan ..... 10-073741
Mar. 15, 1999 [JP] Japan ..... 11-067877

[51] Int. Cl.[7] ..... B41F 31/00

[52] U.S. Cl. ..... 101/350.6; 101/364

[58] Field of Search ..... 101/160–162, 101/167, 202, 205–208, 210, 305, 309, 310, 314, 315, 320, 321, 324, 326, 329–331, 348, 349.1, 350.1, 350.6, 363, 364, 350.5

[56] References Cited

U.S. PATENT DOCUMENTS 2,377,110 5/1945 Smith ..... 101/350.6
4,378,735 4/1983 MacPhee ..... 101/364
4,419,932 12/1983 Cappel ..... 101/363
5,161,462 11/1992 Okamura et al. ..... 101/365
5,243,907 9/1993 Weishew ..... 101/364
5,410,961 5/1995 DeNicola et al. ..... 101/363

FOREIGN PATENT DOCUMENTS 0236105 9/1987 European Pat. Off. .
1-54197 B2 11/1989 Japan .
6-46675 Y2 11/1994 Japan .

*Primary Examiner*—Kimberly L. Asher

[57] ABSTRACT

An inking device comprises an ink fountain device including a blade provided so as to be movable toward and away from a circumferential surface of an ink fountain roller, a pair of side plates provided in both side end portions of the blade, and a holder for supporting the blade and the pair of side plates. The ink fountain device is supported on an ink fountain support member so as to be movable along an axial direction of the ink fountain roller. The ink fountain support member extends along the axial direction of the ink fountain roller. The side plates are always urged toward the ink fountain roller by compression springs, and are pivotably supported, so that the side plates are automatically brought into intimate contact with the circumferential surface of the ink fountain roller.

11 Claims, 12 Drawing Sheets

COMBINED INK FOUNTAIN AND BLADE MOUNTED TO MOVE ALONG LENGTH OF FOUNTAIN ROLL

BACKGROUND OF THE INVENTION

1. Field of the Invention

The present invention relates to an inking device equipped with an ink fountain device which allows ink in an ink fountain to flow out continually in a predetermined amount.

2. Description of the Related Art

An inking device supplies printing ink to a plate mounted on a plate cylinder of a web offset printing press or the like. The inking device is composed of an ink fountain device for allowing ink, stored in an ink fountain, to flow out in a predetermined amount at a time, and a group of many rollers for guiding the ink, which has flowed out, to a plate surface while leveling off the ink in different directions.

In recent years, special inks, such as optical variable ink (OVI), have come into use for prevention of forgery particularly in the field of printing of various securities. Generally, special inks are so expensive that they are often applied to small patterns. With an ink fountain device of a width adapted for a conventional paper size (see Japanese Patent Publication No. 54197/89, the amount of ink fed was large. Once fed, the ink could not be reused. Thus, the cost was high compared with the area of printing.

Japanese Utility Model Publication No. 46675/94, for example, discloses an ink fountain device for resolving the above-mentioned drawback. As shown in FIG. 11, an elongated holder 102 is detachably fixed to an upper surface of an ink fountain support member 101 provided beside an ink fountain roller 100. To the holder 102, a blade 103 formed of a steel sheet is secured such that a front end of the blade 103 is nearly in contact with a circumferential surface of the ink fountain roller 100. To the holder 102, a pair of side plates 105 are also fixed via support fittings 104. The side plates 105 are formed in a nearly inverted triangular shape, have side surfaces pressed against both edges of the blade 103, and have front end arcuate surfaces pressed against the circumferential surface at both ends of the ink fountain roller 100. The side plates 105, the circumferential surface of the ink fountain roller 100, and the blade 103 define a gutter-shaped ink fountain 106. Between the right and left side plates 105, a holder shaft 107 parallel to the ink fountain roller 100 is supported on the ink fountain support member 101 via brackets 108 in proximity to a rear end of the holder 102 for the blade. On the holder shaft 107, a plurality of (three in the drawing) divisional interceptor devices 109 are arranged parallel to each other so as to be movable and adjustable in an axial direction of the holder shaft 107.

According to the foregoing ink fountain device, two of the divisional interceptor devices 109 are moved on the holder shaft 107 until they are each located at a boundary position between a pattern-corresponding area and a non-pattern-corresponding area. Then, a predetermined ink is put between these divisional interceptor devices 109. By so doing, ink can be supplied to the pattern-corresponding area only, so that the consumption of ink can be decreased.

With the above-described conventional ink fountain device, however, a plurality of adjusting screws (not shown) for adjusting a clearance between the circumferential surface of the ink fountain roller 100 and the front end of the blade 103 are located at fixed positions. Even when the divisional interceptor devices 109 are moved in agreement with the pattern, therefore, the positions of the adjusting screws may fail to fully correspond with the pattern. As a result, the clearance is adjusted incompletely, thereby making it impossible to adjust the amount of ink supply accurately and finely in the direction of paper width.

SUMMARY OF THE INVENTION

Under these circumstances, it is an object of the present invention to provide an inking device which can transfer ink only to the pattern area to reduce the consumption of ink, and which can optimally adjust the amount of ink supply in agreement with the pattern.

To attain the above object, an inking device according to the present invention comprises an ink fountain device including a blade provided so as to be movable toward and away from a circumferential surface of an ink fountain roller, a pair of side plates provided in both side end portions of the blade, and a holder for supporting the blade and the pair of side plates, the ink fountain device being supported on an ink fountain support member so as to be movable along an axial direction of the ink fountain roller, the ink fountain support member extending along the axial direction of the ink fountain roller.

According to the inking device, ink can be transferred only to the pattern area by the movement of the ink fountain device to decrease the consumption of ink, and the amount of ink supplied can be accurately and finely adjusted in agreement with the pattern directly by the advance or retreat of the blade.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

PREFERRED EMBODIMENTS OF THE INVENTION

An inking device according to the present invention will now be described in detail by way of the following Embodiments with reference to the accompanying drawings, but it should be understood that the invention is not restricted thereby.

First Embodiment

Figure 1:
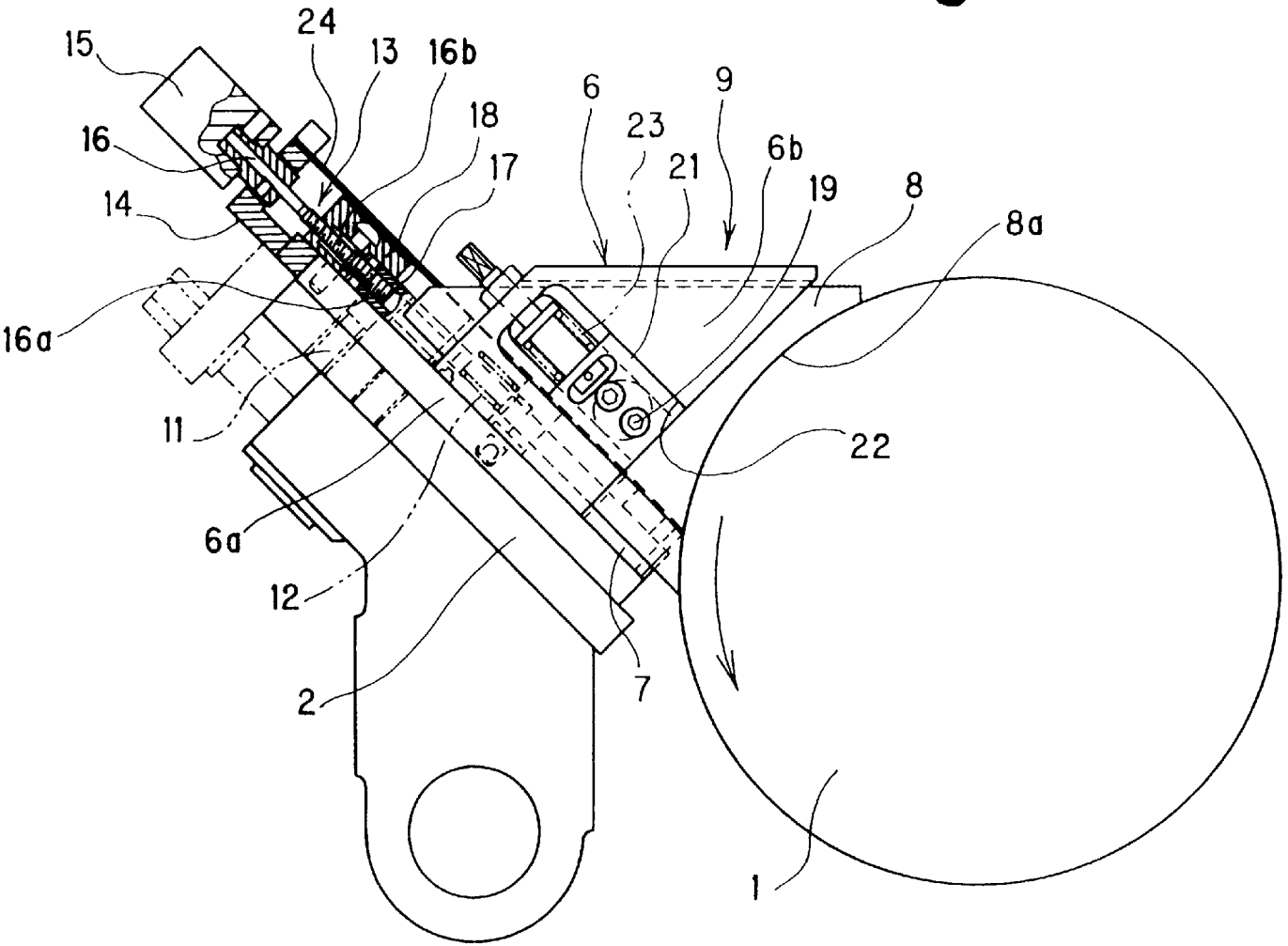
FIG. 1 is a side view of an inking device showing a first embodiment of the present invention.
Figure 2:
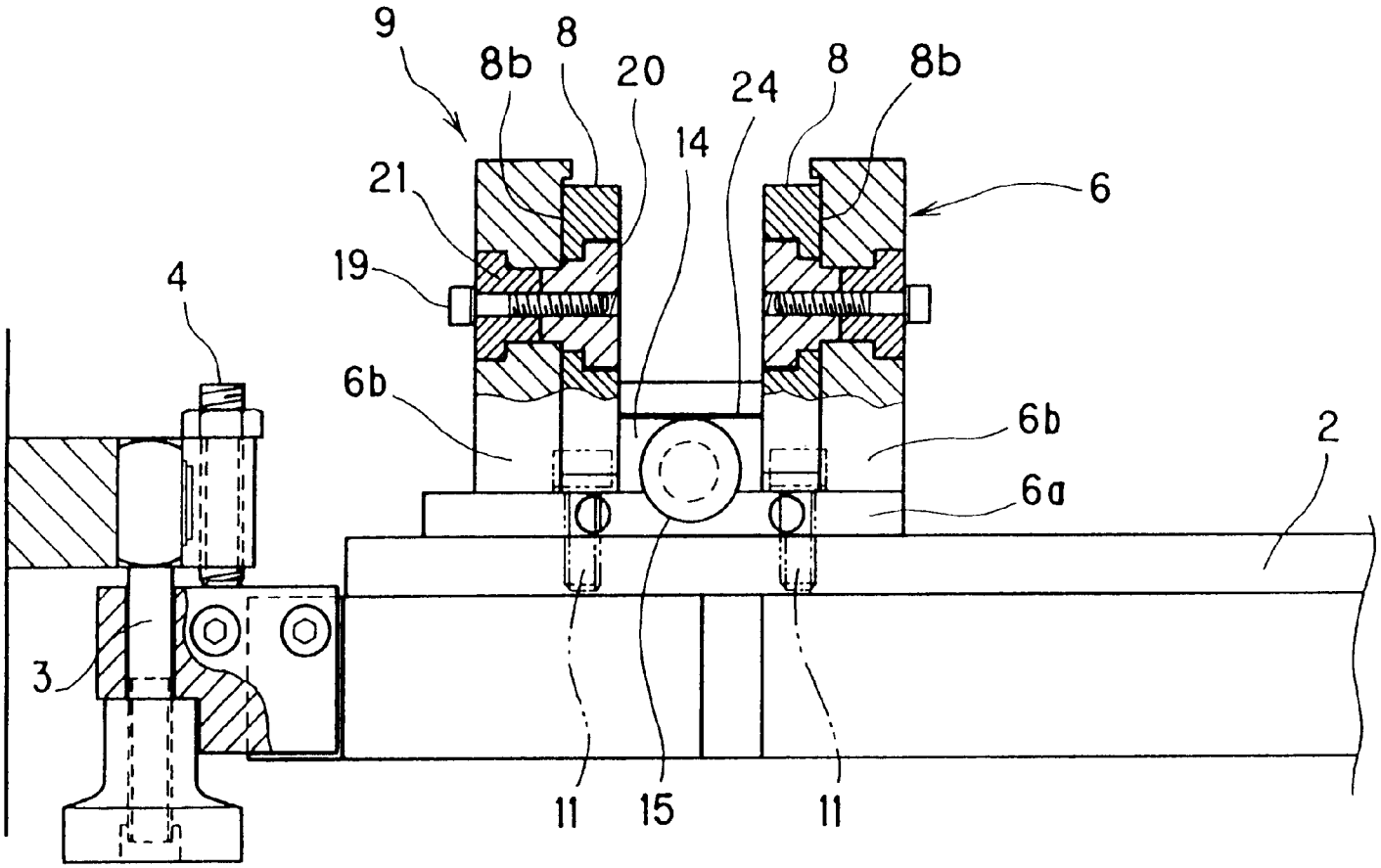
FIG. 2 is a front view of the inking device.
Figure 3:
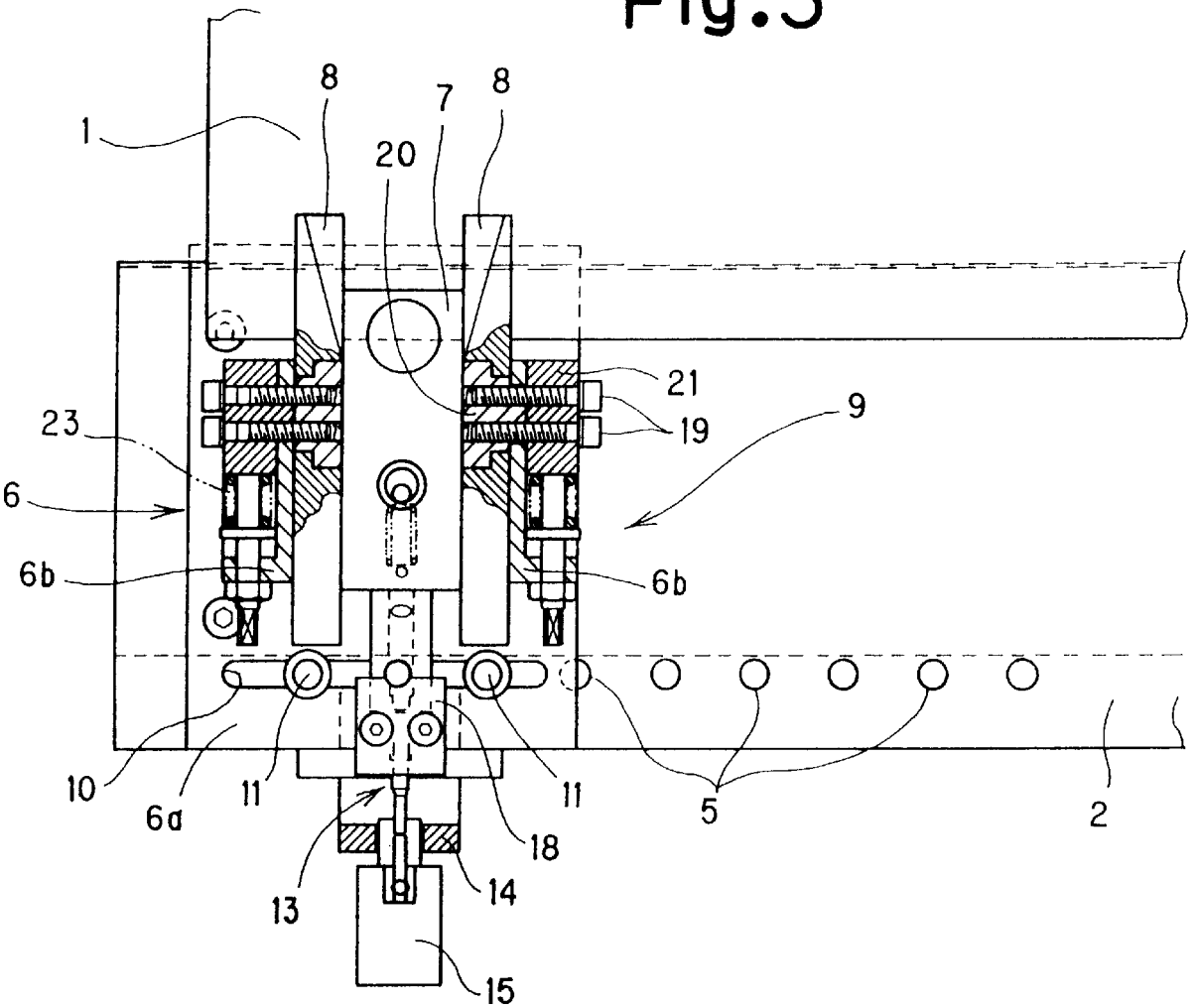
FIG. 3 is a plan view of the inking device.

FIG. 1 is a side view of an inking device showing a first embodiment of the present invention, FIG. 2 is a front view of the inking device, and FIG. 3 is a plan view of the inking device.

As illustrated, an ink fountain roller 1 is supported via its shaft between right and left frames of a printing press so as to be rotatable in a direction of an arrow in FIG. 1. Beside the ink fountain roller 1, an elongated ink fountain support member 2 is disposed. The ink fountain support member 2 is pivotably supported, at both end portions thereof, by the right and left frames via support pins 3, and can be positioned at a predetermined pivoted position by pressing bolts 4. In the ink fountain support member 2, many threaded bores 5 are formed on a straight line with a predetermined pitch along a rear edge of the ink fountain support member 2. On the ink fountain support member 2, an ink fountain device 9 having a holder 6, a blade 7 and side plates 8, whose constitutions will be described later on, is provided.

The holder 6 is formed in a channel shape from a bottom plate 6*a* and right and left side plates 6*b*. The holder 6 is positioned at a predetermined position on the ink fountain support member 2 by two bolts (fixing means) 11 which screw into the threaded bores 5 through an elongated hole 10 formed in the bottom plate 6*a*.

The blade 7 slides on the bottom plate 6*a* of the holder 6, and its front end portion is adapted to contact and separate from a circumferential surface of the ink fountain roller 1 (i.e., is movable toward and away from the circumferential surface of the roller 1). In detail, the blade 7 is always urged in a direction apart from the ink fountain roller 1 (i.e., rearward) by a compression spring 12 embedded in a lower surface portion of the blade 7, and can also be positioned at a predetermined position by a differential screw mechanism 13 as adjusting means in opposition to the urging force of the compression spring 12. In other words, a clearance between the front end of the blade 7 and the circumferential surface of the ink fountain roller 1 is finely adjusted.

The differential screw mechanism 13 comprises a handle 15 supported by the bottom plate 6*a* of the holder 6 via a handle holder 14, a threaded rod 16 secured to the handle 15 and having a first thread portion 16*a* and a second thread portion 16*b* greater in pitch than the first thread portion 16*a*, a tapped cylinder 17 secured to the blade 7 and screwed to the first thread portion 16*a* of the threaded rod 16, and a guide member 18 fixed to the bottom plate 6*a*, screwed to the second thread portion 16*b* of the threaded rod 16, and guiding a screw-on portion of the tapped cylinder 17.

The side plates 8 are formed in a triangular shape, and are situation on both sides of the blade 7. The left and right side plates 8 are provided as a pair so as to be slidable between wall surfaces of the blade 7 and a wall surface of each of the side plates 6*b* of the holder 6. The side plate 8 is supported by the side plate 6*b* of the holder 6, via a dowel 20 of a circular cross section as a support member, and a dowel 21 of a rectangular cross section as a support member, so as to be pivotable and forwardly and rearwardly movable, the dowel 20 and the dowel 21 being coupled together by bolts 19. More specifically, the side plate 8 is fitted around and supported by the dowel 20 of a circular cross section so as to be pivotable in a vertical plane 8*b*. Also, the side plate 8 can move forward and rearward because of the dowel 21 of a rectangular cross section slidably fitted into a rectangular notch 22 with an open front end face which is formed in the side plate 6*b* of the holder 6. The dowel 21 of a rectangular cross section is constantly urged forward (i.e., toward the ink fountain roller 1) by a compression spring 23, whereupon an arcuate surface 8*a* at the front end of the side plate 8 is brought into elastic contact with the circumferential surface of the ink fountain roller 1 at a predetermined contact pressure.

Thus, the circumferential surface of the ink fountain roller 1, the blade 7, and the right and left side plates 8 as a pair, together constitute an ink fountain of a predetermined capacity. The reference numeral 24 denotes a steel sheet laid on an upper surface of the blade 7, etc.

According to the foregoing constitution, the holder 6 is fixed at a predetermined position (in alignment with a pattern) on the ink fountain support member 2 by the two bolts 11 prior to printing of various securities. At this time, the bolts 11 pass through the elongated hole 10 formed in the bottom plate 6*a* of the holder 6. In accordance with a combination of the elongated hole 10 and the threaded bores 5, therefore, the holder 6 is positioned and fixed in a stepless manner at the optimal position corresponding to the pattern.

The right and left side plates 8 as a pair are always urged forward by the compression springs 23 via the dowels 21 of a rectangular cross section, and can be pivoted in the vertical planes 8*b* via the dowels 20 of a circular cross section. Thus, the side plates 8 are automatically brought into intimate contact with the circumferential surface of the ink fountain roller 1, so that the assembly error, etc. of the side plates 8 are accommodated, and follow-up characteristics for the wear or the like of the side plates 8 are also ensured. In other words, a grinding operation which has been performed so far need not be accurate, and the frequency of adjustment is markedly reduced.

After the holder 6 is positioned in the above manner, ink is fed into the ink fountain constructed by the circumferential surface of the ink fountain roller 1, the blade 7, and the right and left side plates 8 as a pair. When the ink fountain roller 1 is rotated, ink flows out through the clearance between the circumferential surface of the ink fountain roller 1 and the front end of the blade 7 to form an ink film on the circumferential surface of the ink fountain roller 1. Then, the handle 15 is turned to cause the differential screw mechanism 13 to position the blade 7 at a predetermined position. In this manner, the clearance between the front end of the blade 7 and the circumferential surface of the ink fountain roller 1 is directly finely adjusted, whereby the amount of ink supplied is accurately adjusted to agree with the pattern.

According to the present embodiment, required ink can be transferred, in the foregoing manner, from the ink fountain not more than 100 mm wide to the pattern area only. Thus, the consumption of ink can be decreased. Furthermore, the advance or retreat of the narrow blade 7 directly results in the fine adjustment of the amount of ink supply in agreement with the pattern. This way of adjustment can avoid the phenomenon that a conventional wide blade gently deforms in the direction of paper width under the action of adjusting screws, thereby causing transfer of ink to areas other than the pattern.

On the other hand, when the ink fountain support member 2 is pivoted, and positioned at a pivoted position by the support pins 3 and the pressing bolts 4 situated beside the right and left frames, the side plates 8 pivot about the dowels 20 of a circular cross section and straightly move because of the dowels 21 of a rectangular cross section. These motions prevent the occurrence of clearance due to twists of the arcuate surface 8*a* at the front end of the side plate 8 and the circumferential surface of the ink fountain roller 1 relative to each other.

According to the present embodiment, the threaded bores 5 are formed in the ink fountain support member 2, and the elongated hole 10 is formed in the holder 6, but the elongated hole 10 may be formed in the ink fountain support member 2, and the threaded bores 5 may be formed in the holder 6.

Second Embodiment

Figure 4:
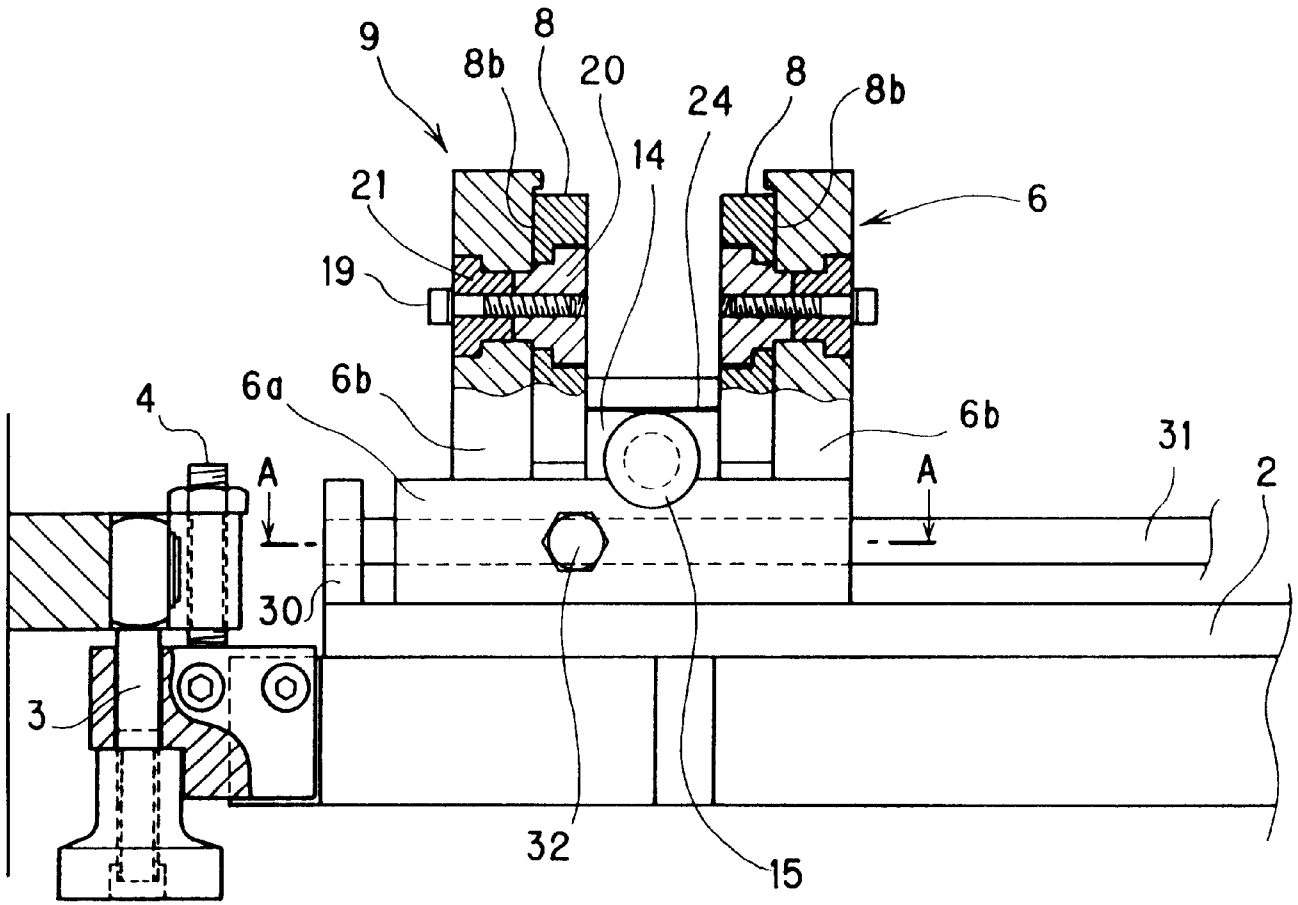
FIG. 4 is a front view of an inking device showing a second embodiment of the present invention.
Figure 5:
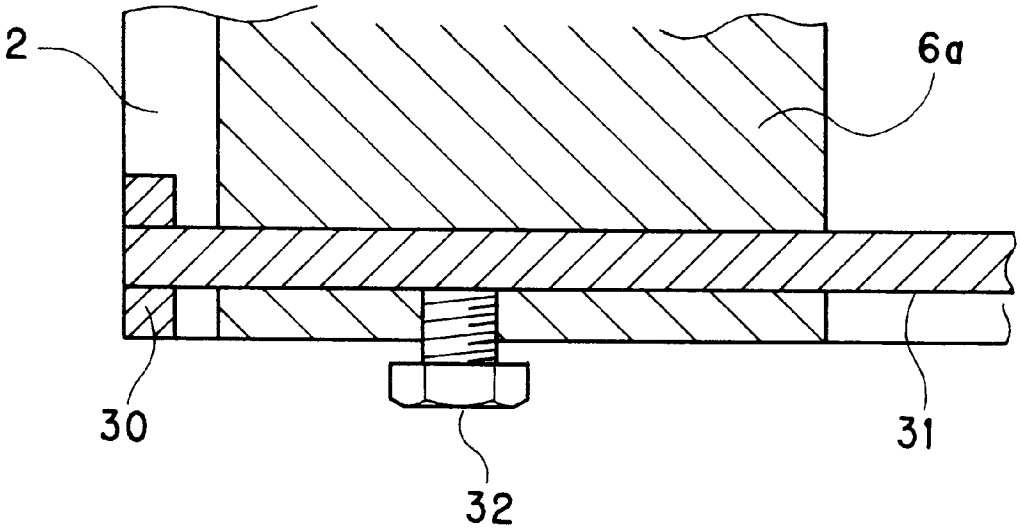
FIG. 5 is a sectional view taken on line A—A of FIG. 4.

FIG. 4 is a front view of an inking device showing a second embodiment of the present invention, and FIG. 5 is a sectional view taken on line A—A of FIG. 4.

According to this embodiment, the combination of the threaded bores 5 and the elongated hole 10 in the first embodiment is not used; instead, the holder 6 itself, i.e., an ink fountain, can be moved on a guide shaft 31 spanned over an ink fountain support member 2 via a pair of (right and left) brackets 30, and can be fixed at an arbitrary position by a fixing bolt 32. This second embodiment gives the same actions and effects as in the first embodiment.

Third Embodiment

Figure 6A:
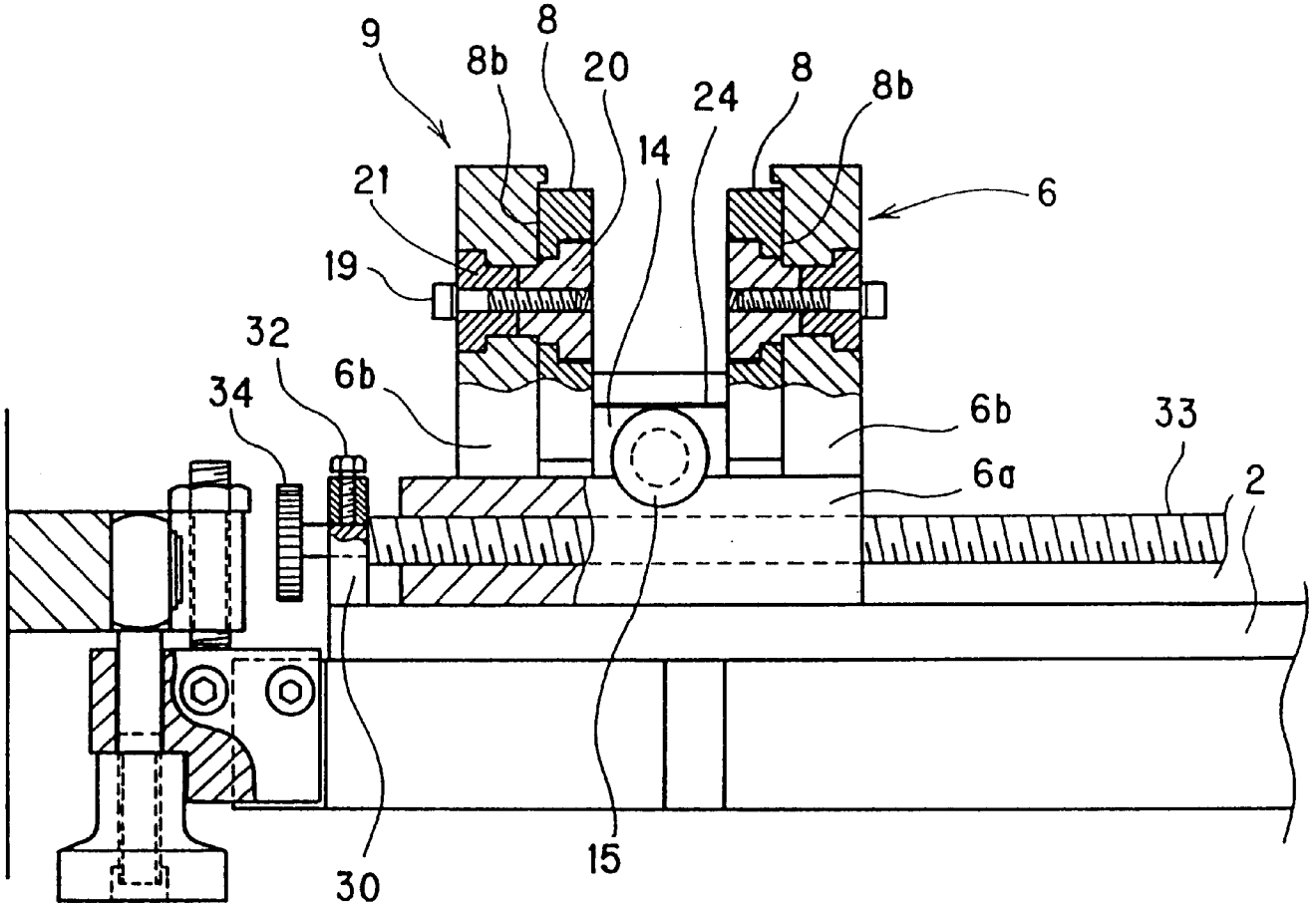
FIGS. 6*a* and 6*b* are front views of an inking device showing a third embodiment of the present invention.

FIG. 6*a* is a front view of an inking device showing a third embodiment of the present invention.

Figure 6B:
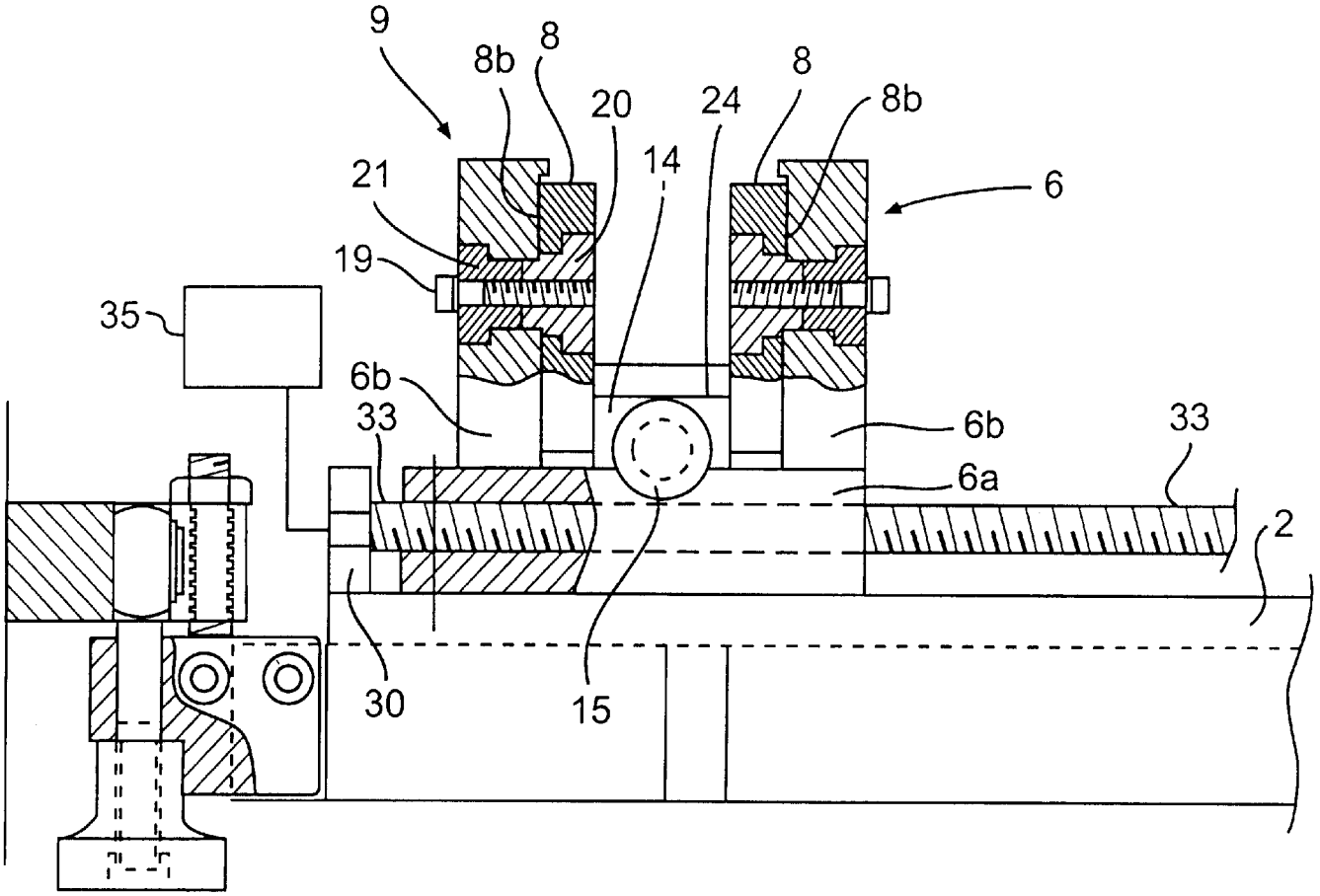

According to this embodiment, the guide shaft 31 in the second embodiment is replaced by a threaded shaft 33 screwed to an internal thread portion (not shown) of a holder 6. This threaded shaft 33 is turned by a handle 34 as turning means to move a holder 6 on an ink fountain support member 2 in a longitudinal direction. Turning of the threaded shaft 33 is restricted by a fixing bolt 32. This third embodiment also gives the same actions and effects as in the first embodiment. As shown in FIG. 6*b*, a motor 35 may be used instead of the handle 34. The use of the motor 35 makes the fixing bolt 32 unnecessary, since a brake on the motor 35 retrains the turning of the threaded shaft 33.

Fourth Embodiment

Figure 7:
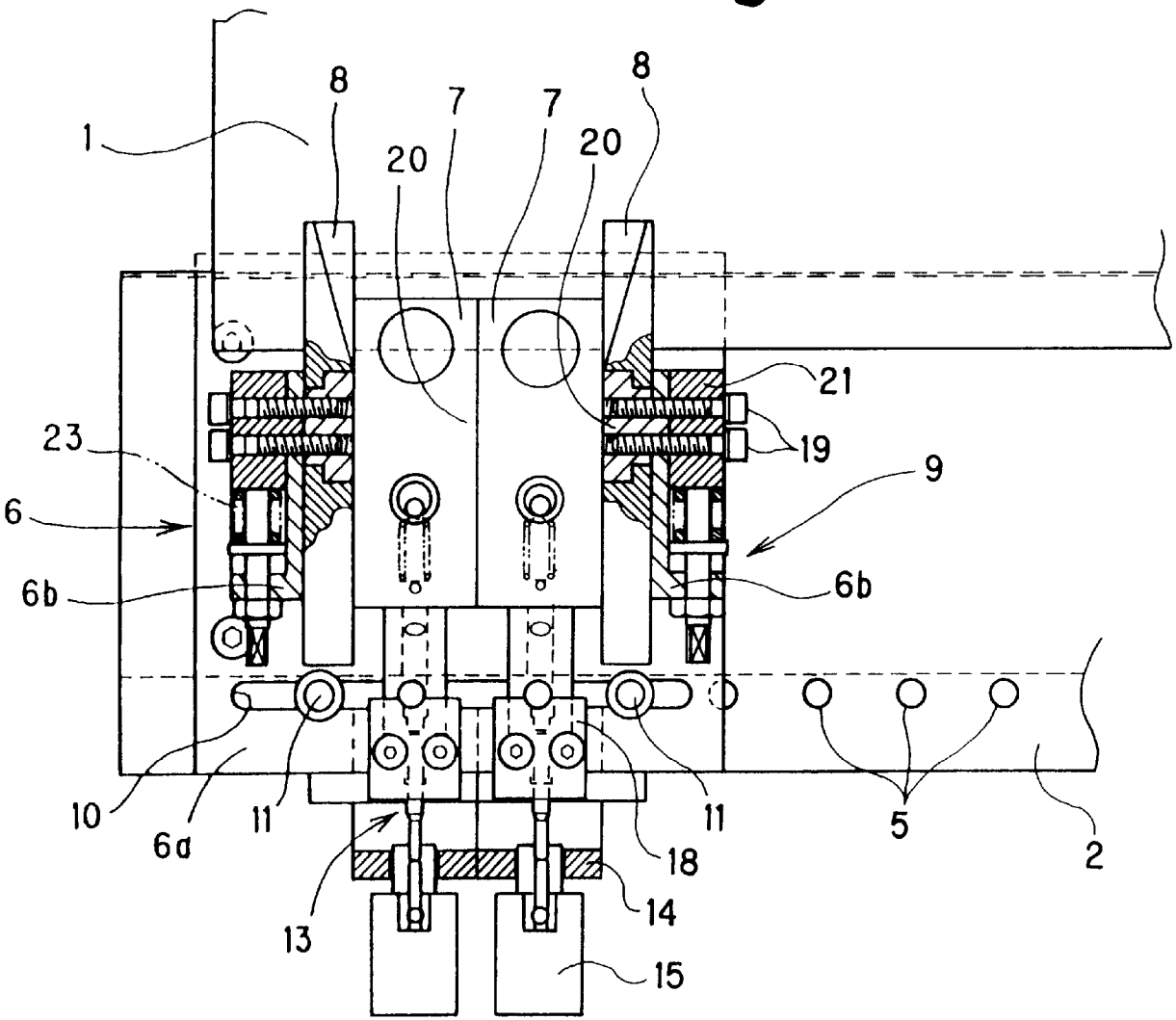
FIG. 7 is a plan view of an inking device showing a fourth embodiment of the present invention.

FIG. 7 is a plan view of an inking device showing a fourth embodiment of the present invention.

This is an embodiment in which two blades 7 are mounted side by side in a holder 6, together with differential screw mechanisms 13, along an axial direction of an ink fountain roller 1. This embodiment also gives the same actions and effects as in the first embodiment. Three or more of the blades 7 may be provided in the holder 6.

Fifth Embodiment

Figure 8:
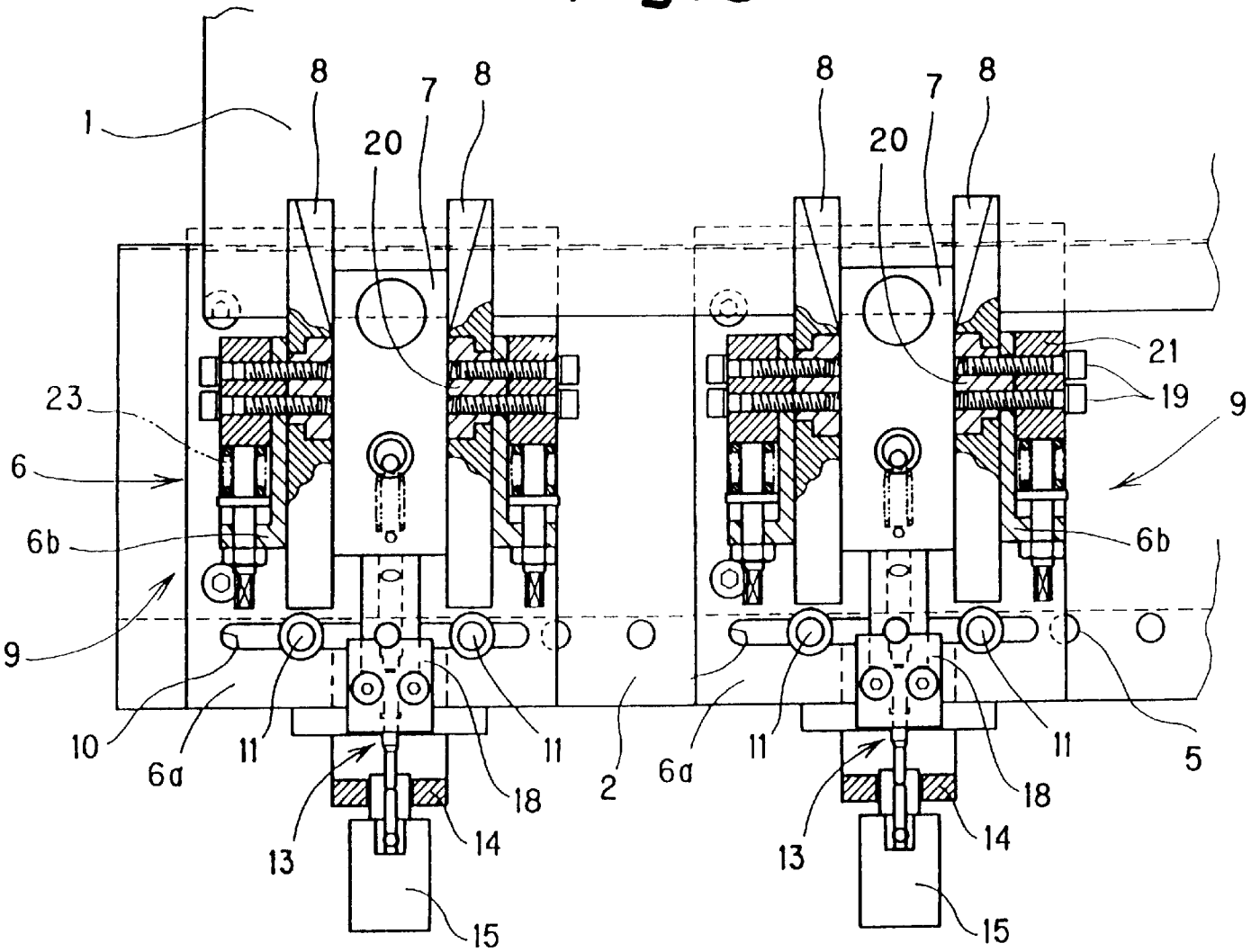
FIG. 8 is a plan view of an inking device showing a fifth embodiment of the present invention.

FIG. 8 is a plan view of an inking device showing a fifth embodiment of the present invention.

This is an embodiment in which a plurality of holders 6 themselves, i.e., ink fountain devices 9, are disposed along an axial direction of an ink fountain roller 1. This embodiment also gives the same actions and effects as in the first embodiment. This embodiment is advantageous in that it can be adapted, with high accuracy, for a plurality of patterns present in the width direction of paper.

Sixth Embodiment

Figure 9:
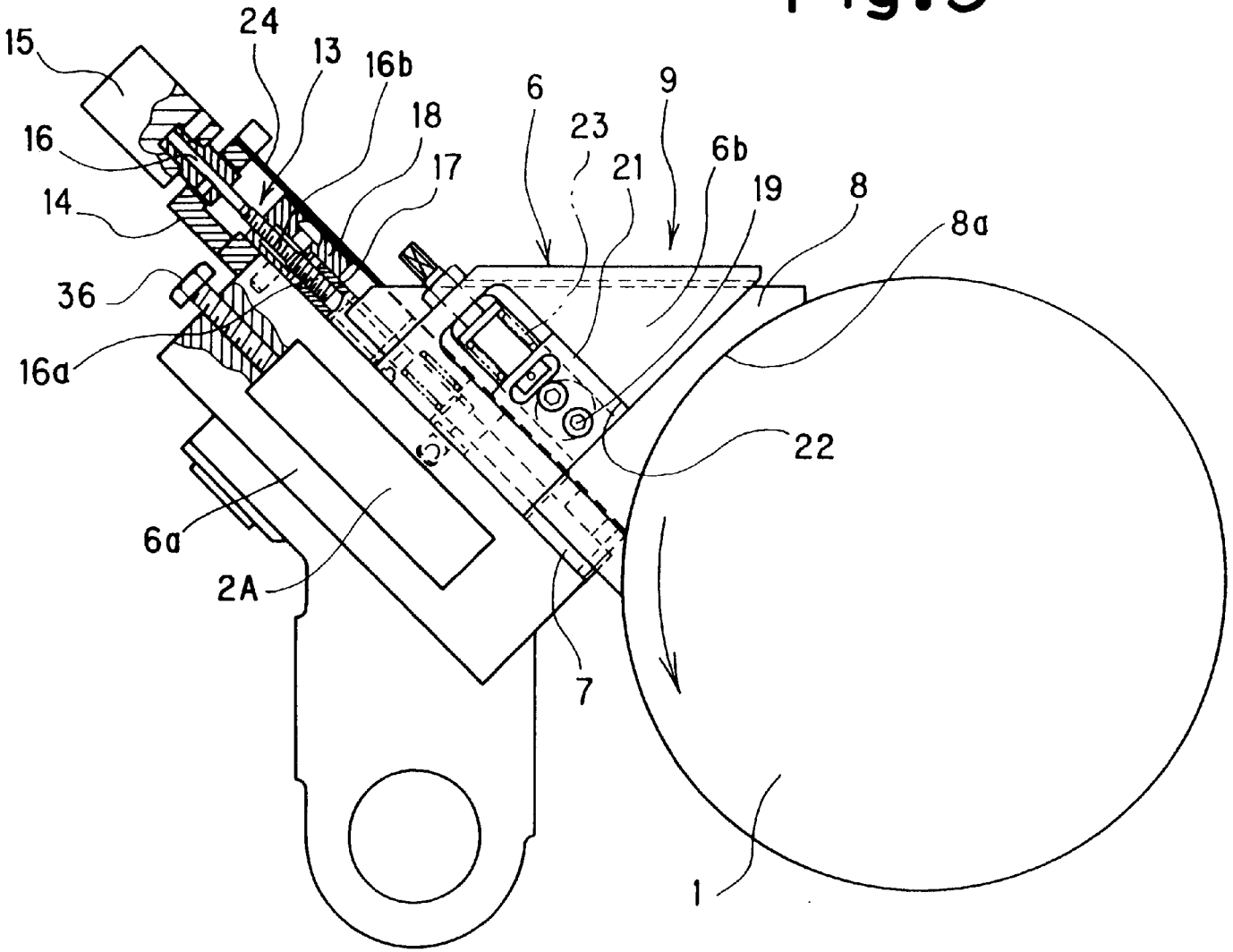
FIG. 9 is a side view of an inking device showing a sixth embodiment of the present invention.
Figure 10:
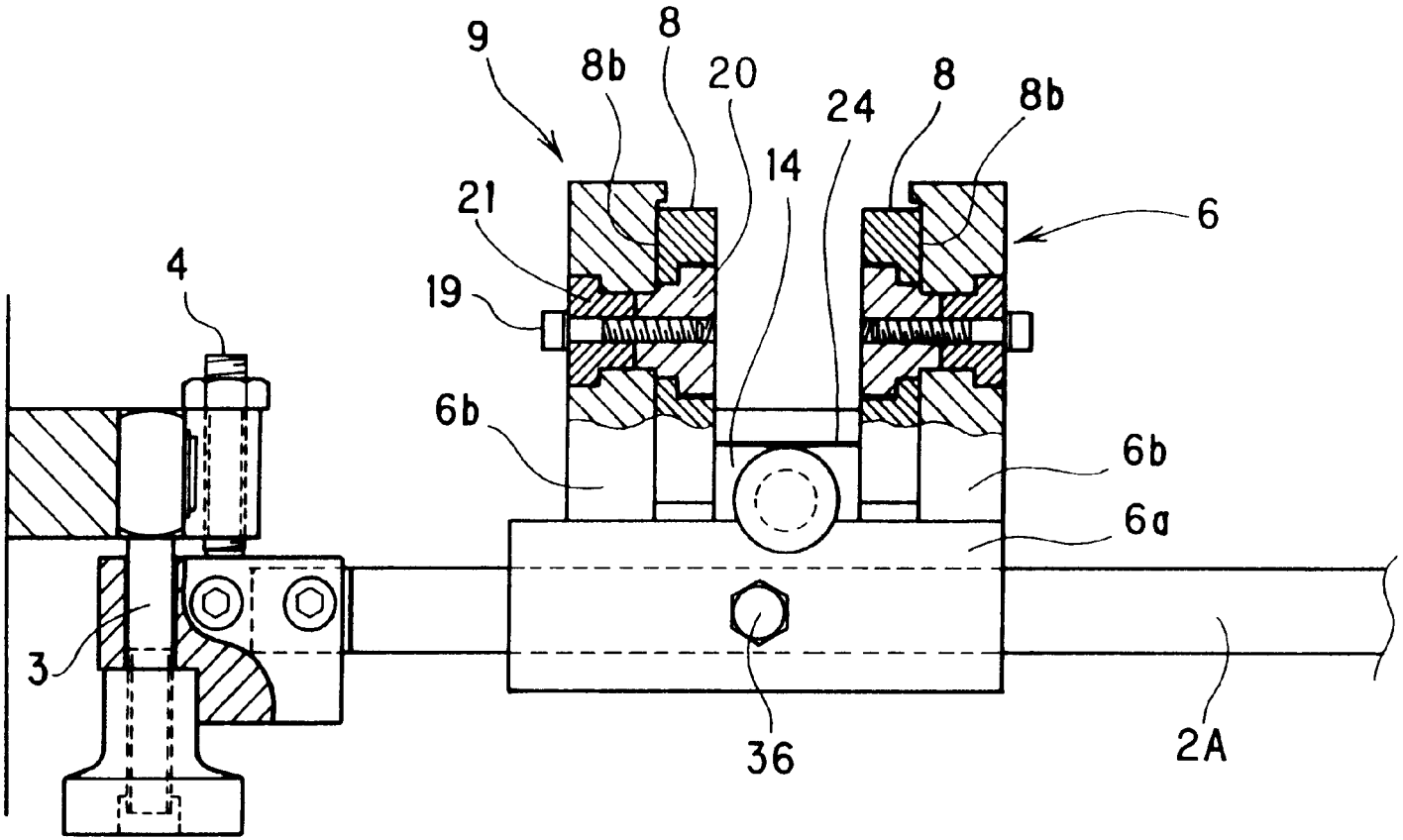
FIG. 10 is a front view of the inking device according to the sixth embodiment.
Figure 11:
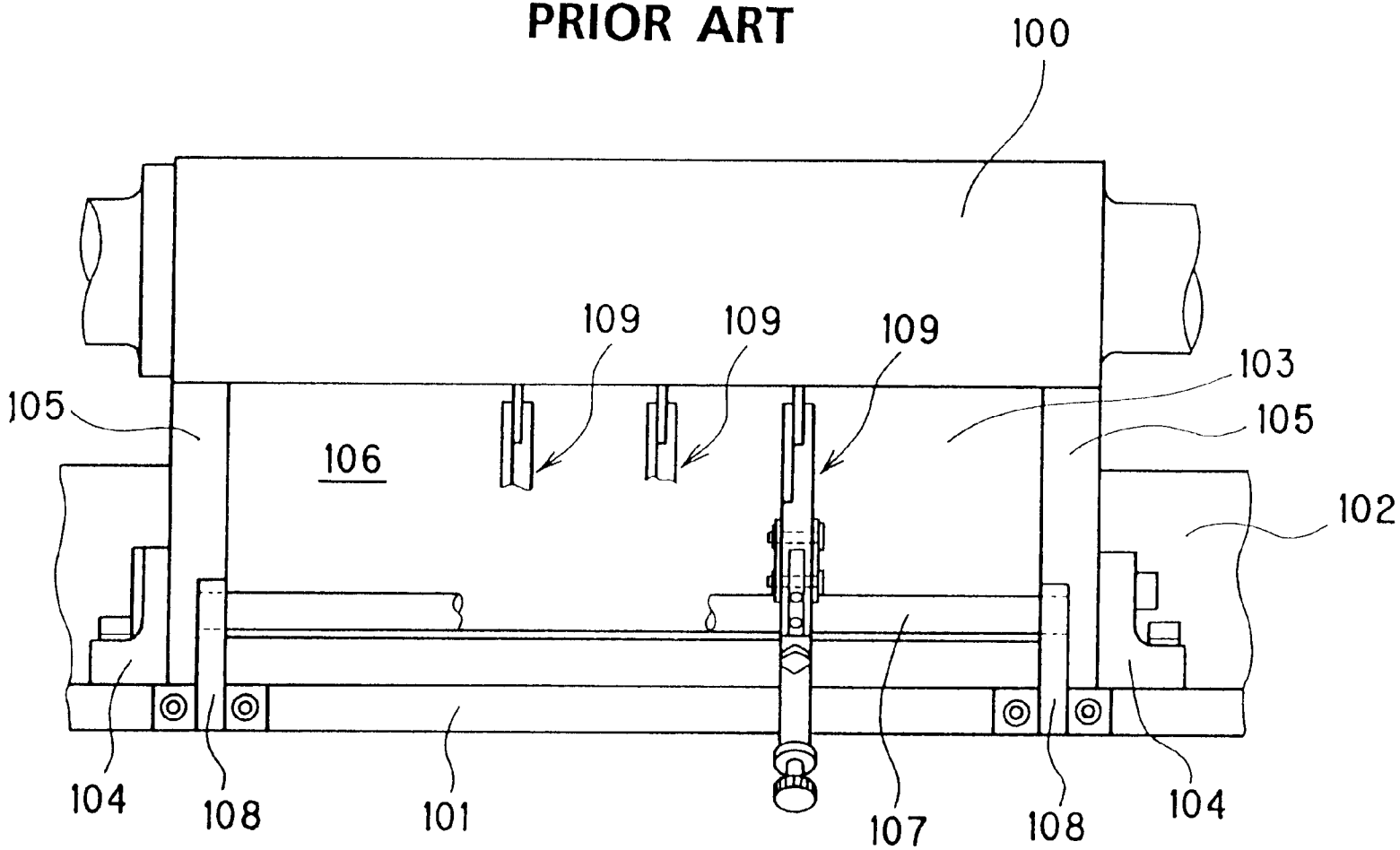
Fig. 11 PRIOR ART
FIG. 11 is a plan view of a conventional ink fountain device.

FIG. 9 is a side view of an inking device showing a sixth embodiment of the present invention, and FIG. 10 is a front view of the inking device.

This is an embodiment in which an ink fountain support member 2 as revealed in the first to fifth embodiments is composed of a support bar 2A for supporting a holder 6 (ink fountain device 9) and guiding the holder 6 during its movement along an axial direction of an ink fountain roller 1. In the drawing, the numeral 36 denotes a fixing bolt. This embodiment also gives the same actions and effects as in the first embodiment.

This invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An inking device comprising:

an ink fountain device including a blade provided so as to be movable toward and away from a circumferential surface of an ink fountain roller, a pair of side plates provided in both side end portions of the blade, and a holder for supporting the blade and the pair of side plates, said ink fountain device being supported on an ink fountain support member so as to be movable along an axial direction of the ink fountain roller, said ink fountain support member extending along the axial direction of the ink fountain roller.

2. The inking device of claim 1, wherein each of the side plates is always urged toward the ink fountain roller by an elastic member.

3. The inking device of claim 1, wherein each of the side plates is pivotably supported, and has an arcuate surface automatically brought into intimate contact with the circumferential surface of the ink fountain roller.

4. The inking device of claim 1, wherein the ink fountain device includes:

support members for supporting the side plates pivotably, said support members being supported by the holder so as to be movable toward and away from the circumferential surface of the ink fountain roller;

elastic members for urging the support members toward the ink fountain roller; and an adjusting unit for bringing the blade close to or apart from the circumferential surface of the ink fountain roller.

5. The inking device of claim 4, wherein the adjusting unit includes a differential screw having a first thread portion screwed to a blade side, and a second thread portion screwed to a holder side and different in thread pitch from the first thread portion.

6. The inking device of claim 1, further comprising a fixing unit for fixing the holder of the ink fountain device to the ink fountain support member at an arbitrary position along the axial direction of the ink fountain roller.

7. The inking device of claim 1, wherein the ink fountain support member is provided with a guide member for guiding the ink fountain device during its movement along the axial direction of the ink fountain roller.

8. The inking device of claim 1, further comprising:

a threaded shaft supported turnably by the holder of the ink fountain device and screwed to a thread portion provided in the holder; and a turning unit for turning the threaded shaft.

9. The inking device of claim 1, wherein a plurality of the blades are provided, the blades are arranged side by side along the axial direction of the ink fountain roller, and each of the blades is provided with an adjusting unit for bringing the blade close to or apart from the circumferential surface of the ink fountain roller.

10. The inking device of claim 1, wherein a plurality of the ink fountain devices are disposed along the axial direction of the ink fountain roller.

11. The inking device of claim 1, wherein the ink fountain support member is a support bar for supporting the holder and guiding the holder during its movement along the axial direction of the ink fountain roller.

* * * * *